US011821060B2

(12) United States Patent
Sallot et al.

(10) Patent No.: US 11,821,060 B2
(45) Date of Patent: Nov. 21, 2023

(54) SUPERALLOY WITH OPTIMIZED PROPERTIES AND A LIMITED DENSITY

(71) Applicants: SAFRAN, Paris (FR); CENTRE NATIONAL DE LA RECHERCHE SCIENTIFIQUE, Paris (FR); UNIVERSITE PARIS EST CRETEIL VAL DE MARNE, Creteil (FR)

(72) Inventors: Pierre Jean Sallot, Moissy-Cramayel (FR); Clara Desgranges, Moissy-Cramayel (FR); Anne-Laure Rouffie, Moissy-Cramayel (FR); Jean-Philippe François Couzinie, Paris (FR); Guy Dirras, St Brice Sous Forêt (FR); Ivan Georges Guillot, Paris (FR); Jean-Marc Eric Joubert, Paris (FR); Mathilde Madeleine Louise Laurent, Antony (FR); Loic Perriere, Châtenay Malabry (FR); Thomas Philippe Joseph Rieger, Gentilly (FR)

(73) Assignees: SAFRAN, Paris (FR); CENTRE NATIONAL DE LA RECHERCHE SCIENTIFIQUE, Paris (FR); UNIVERSITE PARIS EST CRETEIL VAL DE MARNE, Creteil (FR)

( * ) Notice: Subject to any disclaimer, the term of this patent is extended or adjusted under 35 U.S.C. 154(b) by 159 days.

(21) Appl. No.: 17/437,730

(22) PCT Filed: Mar. 13, 2020

(86) PCT No.: PCT/FR2020/050540
§ 371 (c)(1),
(2) Date: Sep. 9, 2021

(87) PCT Pub. No.: WO2020/188205
PCT Pub. Date: Sep. 24, 2020

(65) Prior Publication Data

US 2022/0145428 A1 May 12, 2022

(30) Foreign Application Priority Data

Mar. 20, 2019 (FR) ..... 1902852

(51) Int. Cl.
*C22C 19/05* (2006.01)
*C22F 1/10* (2006.01)

(52) U.S. Cl.
CPC ..... *C22C 19/056* (2013.01); *C22F 1/10* (2013.01)

(58) Field of Classification Search
CPC ..... C22C 19/056; C22C 30/00; C22F 1/10
See application file for complete search history.

(56) References Cited

U.S. PATENT DOCUMENTS

| | | | |
|---|---|---|---|
| 5,169,463 | A | 12/1992 | Doherty et al. |
| 2003/0111138 | A1 | 6/2003 | Cetel |

FOREIGN PATENT DOCUMENTS

| | | | |
|---|---|---|---|
| CN | 1432659 | A | 7/2003 |
| EP | 3 263 722 | A1 | 1/2018 |
| JP | 2018-145456 | A | 9/2018 |
| WO | WO 2015/012888 | A1 | 1/2015 |
| WO | WO 2019/018038 | A1 | 1/2019 |

OTHER PUBLICATIONS

Yan Jiangfeng, Public Evidence 1 "Chromium Metallurgy," Mettallurgical Industry Presspp., pp. 329-331, Feb. 2007.
Cao Xiaoming, Public Evidence 2 "Advanced Structural Materials," Chemical Industry Press, pp. 65-70, Apr. 2005.
International Search Report as issued in International Patent Application No. PCT/FR2020/050540, dated Sep. 28, 2020.

*Primary Examiner* — Jessee R Roe
(74) *Attorney, Agent, or Firm* — Pillsbury Winthrop Shaw Pittman LLP

(57) ABSTRACT

A nickel-based superalloy includes, in atomic percentages, 13% to 21% chromium, 15% to 26% cobalt, 4% to 8% aluminum, 4.5% to 8% titanium, 8% to 18% iron, boron in an atomic percentage less than or equal to 0.5% or no boron, carbon in an atomic percentage less than or equal to 1% or no carbon, at least one additional element selected from molybdenum, tungsten, tantalum and niobium, a total atomic content of the at least one additional element being less than or equal to 1.5% or no such at least one additional element, the remainder being nickel and unavoidable impurities, with a sum of the atomic percentages of aluminum and titanium being comprised between 8.5% and 15%. The novel superalloy composition has a limited density and exhibiting, when hot, good mechanical properties as well as good resistance to oxidation and corrosion.

2 Claims, 4 Drawing Sheets

[Fig. 1]
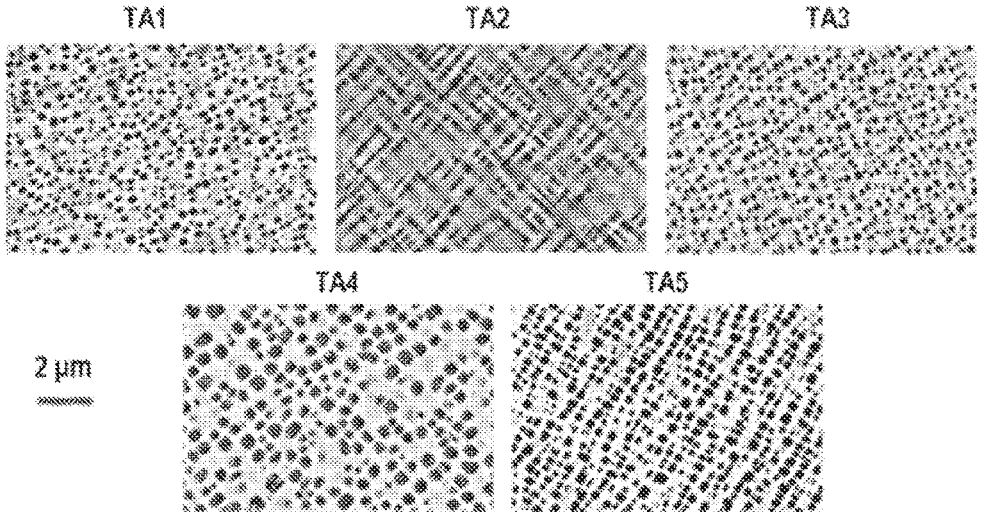
[Fig. 2]
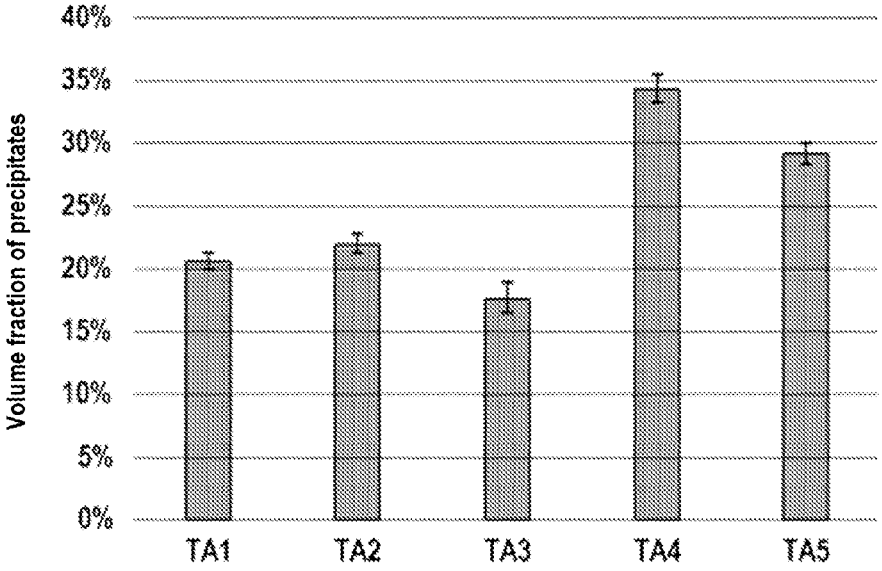

[Fig. 3]
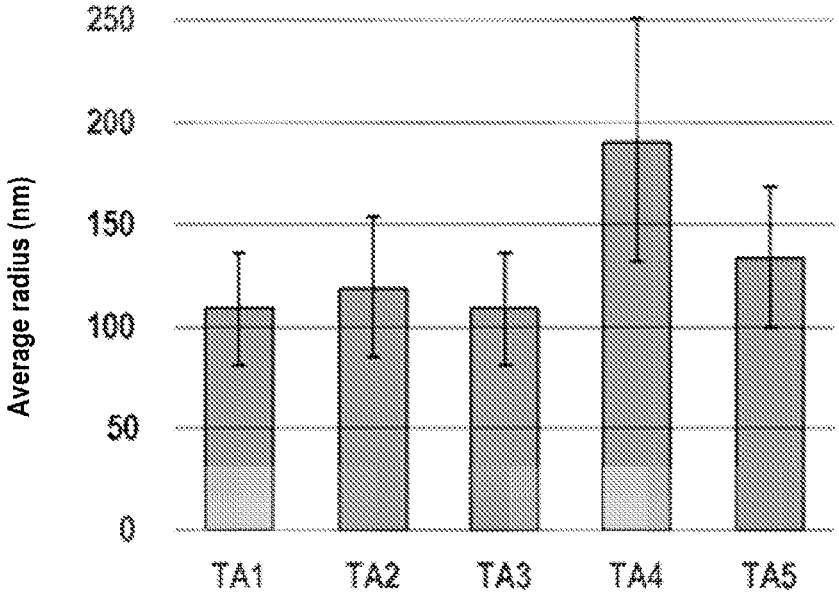
[Fig. 4]
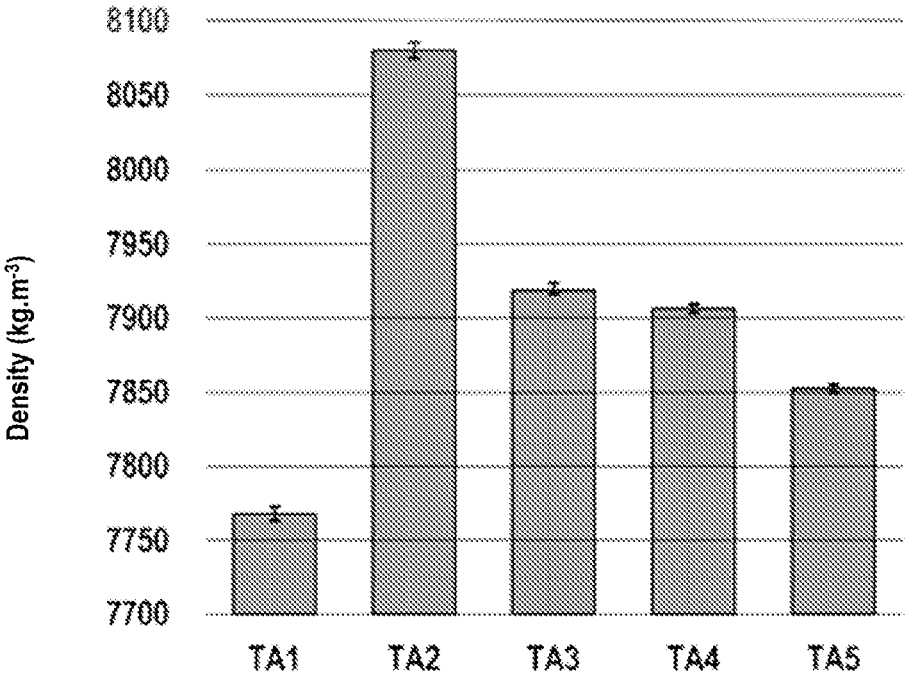

[Fig. 5]
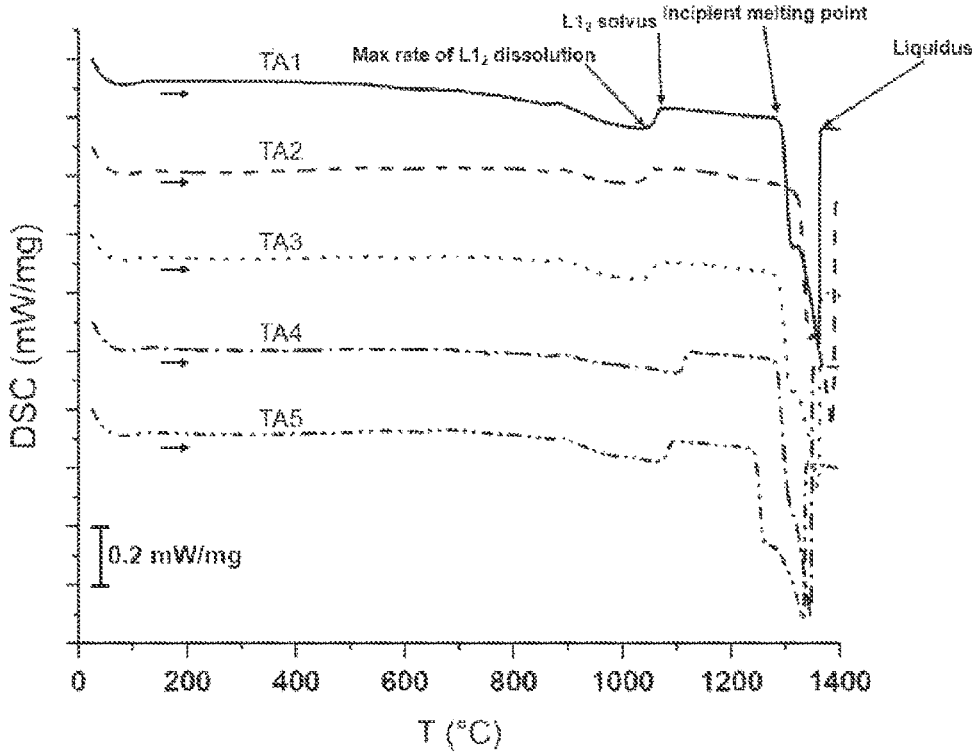
[Fig. 6]
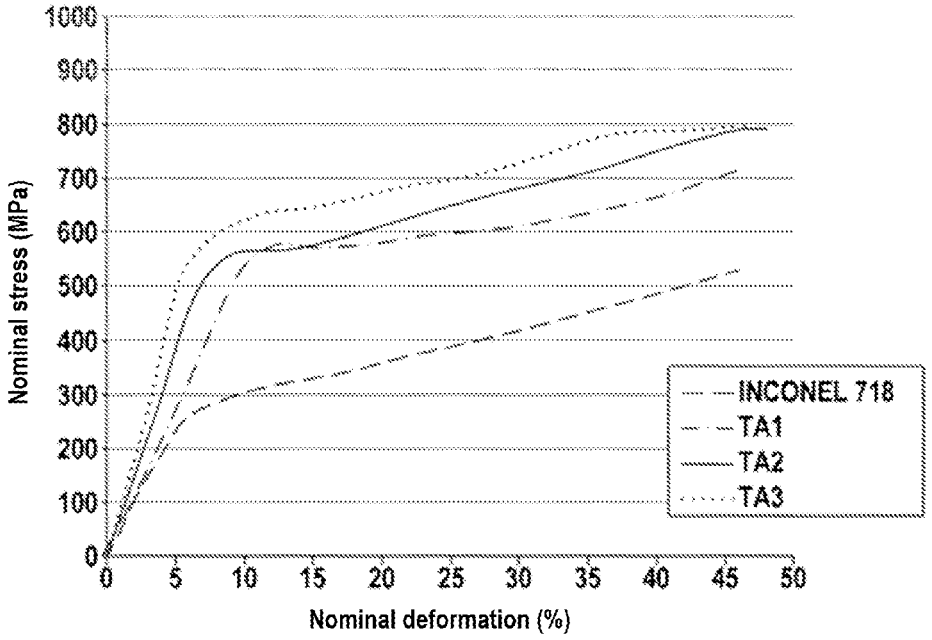

[Fig. 7]
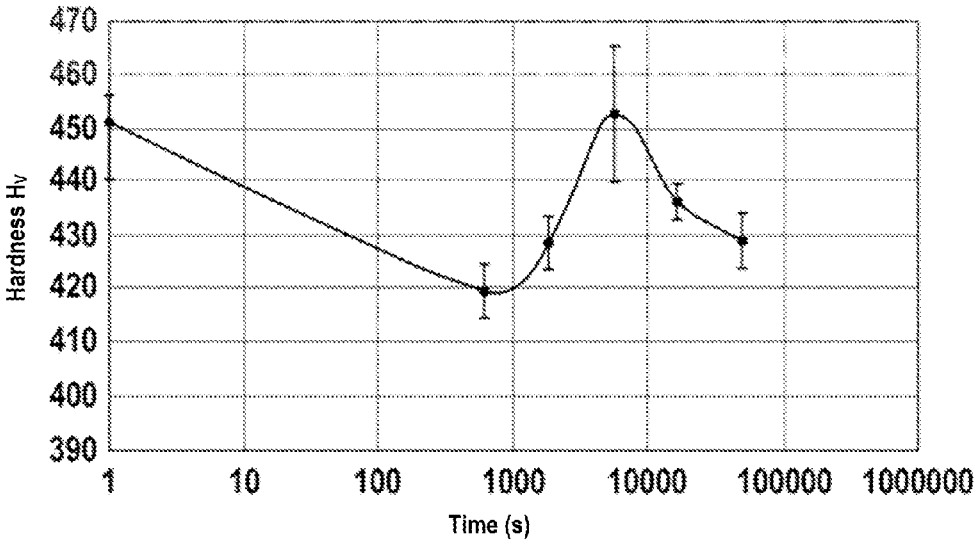

SUPERALLOY WITH OPTIMIZED PROPERTIES AND A LIMITED DENSITY

CROSS-REFERENCE TO RELATED APPLICATIONS

This application is the U.S. National Stage of PCT/FR2020/050540, filed Mar. 13, 2020, which in turn claims priority to French patent application number 1902852 filed Mar. 20, 2019. The content of these applications are incorporated herein by reference in their entireties.

TECHNICAL FIELD

The invention relates to novel superalloy compositions having a limited density and exhibiting, when hot, good mechanical properties as well as good resistance to oxidation and corrosion. In particular, the invention relates to the application of such superalloys to form aeronautical gas turbine engine parts.

PRIOR ART

In the context of the development of new-generation aeronautical turbines, materials with improved resistance to oxidation and corrosion when hot (typically in the 800° C.-1000° C. range) and limited density are sought.

Accordingly, high-entropy alloys (HEA) or complex concentrated alloys (CCA) have been developed. In particular, work has been carried out to identify novel alloys with precipitates of gamma-prime hardening phases in the alloy matrix.

However, it has been observed that, when exposed to high temperatures, the microstructure of these alloys can be affected insofar as particles of undesirable phases may appear, namely topologically close-packed (TCP) phases. The appearance of these phases can lead to a lowering of the mechanical properties of the alloy.

JP 2018-145456 is known to disclose high-entropy alloys.

It is therefore desirable to have novel alloy compositions with a limited density and exhibiting, when hot, good mechanical properties as well as good resistance to oxidation and corrosion.

DISCLOSURE OF THE INVENTION

To this end, the invention proposes, according to a first embodiment, a nickel-based superalloy comprising, in atomic percentages, 13% to 21% chromium, 4% to 30% cobalt, 4% to 10% aluminum, 4.5% to 10% titanium, 8% to 18% iron, optionally boron in an atomic percentage less than or equal to 0.5%, optionally carbon in an atomic percentage less than or equal to 1%, optionally at least one additional element selected from molybdenum, tungsten, tantalum and niobium, the total atomic content of the additional element(s) being less than or equal to 1.5%, the remainder being nickel and unavoidable impurities, with the sum of the atomic percentages of aluminum and titanium being comprised between 8.5% and 15%.

The invention further proposes, according to a second embodiment, a cobalt-based superalloy comprising, in atomic percentages, 9% to 20% chromium, 22% to 36% nickel, 4% to 10% aluminum, 4% to 10% titanium, 8% to 18% Iron, optionally boron in an atomic percentage less than or equal to 0.5%, optionally carbon in an atomic percentage less than or equal to 1%, optionally at least one additional element selected from molybdenum, tungsten, tantalum and niobium, the total atomic content of the additional element(s) being less than or equal to 1.5%, the remainder being cobalt and unavoidable impurities, with the sum of the atomic percentages of aluminum and titanium being comprised between 8% and 15%.

"X-based superalloy" is understood to mean a superalloy in which the element X is the majority element in atomic percentages. The element X is therefore the element with the highest atomic percentage in the superalloy. The atomic percentage of element X in the X-based superalloy may, but need not, be greater than 50%.

"Unavoidable impurities" are elements that are not intentionally added to the composition and are brought in with other elements.

The two embodiments described above both concern high-entropy superalloys of complex composition having a matrix, called gamma phase, in which precipitates of gamma-prime ($L1_2$) hardening phases are present in significant volume fraction to optimize the mechanical properties at high temperature. The volume fractions of the $L1_2$ precipitates (denoted "$x(L1_2)$") preferably satisfy the following conditions:

$$-50\% \geq x(L1_2) \geq 40\% \text{ at } 800^\circ \text{ C., and}$$

$$-30\% \geq x(L1_2) \geq 20\% \text{ at } 1000^\circ \text{ C.}$$

Moreover, the superalloys according to the two embodiments described above advantageously have a low propensity to form topologically close-packed phases. In these superalloys, the incorporation of elements selected from molybdenum, tungsten, tantalum and niobium is minimized (sum of the contents of these four elements less than or equal to 1.5% in atomic percentages) in order to give them a reduced density. It should be noted, however, that the controlled presence of these latter elements can be advantageous in order to further harden the matrix and the $L1_2$ phases. The superalloys described above also have good resistance to oxidation and corrosion when hot.

The advantageous properties of the superalloys described above will be repeated through the following description indicating the contribution of each of the alloying elements.

Chromium gives the superalloy good resistance to oxidation and corrosion at high temperatures, typically in the temperature range comprised between 800° C. and 1000° C. If the chromium content is too high, it tends to reduce the solvus temperature of the gamma-prime phases, i.e., the temperature above which these phases are dissolved in the gamma matrix. Above the solvus temperature, the gamma-prime phases are dissolved and no longer contribute to the hardness increase of the superalloy. Chromium must therefore be present in sufficient amount to provide the desired resistance to oxidation and corrosion, but its amount must also be limited in order to preserve the precipitates of gamma-prime phases, and thus the increase in hardness of the superalloy, over a wide temperature range. Limiting the chromium content in the superalloy also has the advantage of reducing the formation of topologically close-packed phases with iron as the sigma phase or the B2 phase.

In the case of the first embodiment relating to the nickel-based superalloy, cobalt allows the gamma matrix to be strengthened and reduces the susceptibility to precipitation of topologically close-packed phases. Cobalt also slows down the diffusion of the species, thus promoting the stability of the gamma-prime precipitates. As for chromium, the cobalt content must however be limited so that the solvus temperature of the gamma-prime phases remains high.

In the case of the second embodiment for the cobalt-based superalloy, nickel extends the range of existence of the gamma-prime phase and the solvus of this phase. However, the nickel content must be limited in order to maintain cobalt-doped gamma-prime phases and not form the τ-Ti $(Ni,Co)_3$ phase at the service temperature.

Aluminum and titanium promote the precipitation of gamma-prime hardening phases that have a composition between $(Ni,Co)_3(Al,Ti)$ and $Co_3Ti$. However, the addition of aluminum and titanium must be done in limited proportions so that the gamma matrix always occupies a significant fraction of the superalloy and thus avoid that the mechanical properties at low temperature are negatively affected.

Iron allows the density of the superalloy to be reduced, since this element has a lower density than nickel or cobalt. This is particularly advantageous when the superalloy is to be used in the aeronautical field, where the fact of being able to lighten the mass of the parts is of particular interest. However, the proportion of iron must be limited so as not to promote the formation of iron oxides to the detriment of chromium oxides, and thus maintain the desired resistance to oxidation and corrosion when hot.

Other elements may be present in the superalloy as an option and in limited amounts, namely boron or carbon if the formation of borides or carbides is sought in order to reinforce the strength of the grain boundaries. The unavoidable impurities, in turn, may be present in an atomic percentage less than or equal to 1000 ppm.

The following section describes the preferential features of superalloy compositions.

In the case of the second embodiment, the superalloy may comprise between 13% and 21% chromium in atomic percentages.

Such a high chromium content further increases the resistance to oxidation and corrosion when hot.

In an example embodiment, the superalloy comprises between 4% and 8%, for example between 4.5% and 8%, aluminum in atomic percentages. The superalloy may comprise between 4.5% and 7.5%, for example between 4.5% and 5.5%, aluminum in atomic percentages.

Such high aluminum contents help to optimize the overall mechanical properties of the alloy when hot.

In an example embodiment, the superalloy comprises between 4.5% and 8% titanium in atomic percentages.

Such a titanium content helps to optimize the overall mechanical properties of the alloy when hot.

In an example embodiment, the sum of the atomic percentages of aluminum and titanium is comprised between 9% and 13%.

Such a content helps to optimize the overall mechanical properties of the alloy when hot.

In case of the first embodiment, the superalloy may comprise between 15% and 26% cobalt in atomic percentages. In particular, the superalloy may comprise between 15% and 22% cobalt in atomic percentages.

Such cobalt contents optimize the compromise between stability of the gamma-prime hardening phases and reinforcement of the gamma matrix provided by the cobalt.

In the case of the first embodiment, the superalloy may comprise between 9% and 18% iron in atomic percentages. In particular, the superalloy may comprise between 13% and 18% iron in atomic percentages, for example between 14% and 18% iron in atomic percentages, or even between 15% and 18% iron in atomic percentages.

Such iron contents optimize the compromise between superalloy mass reduction and resistance to oxidation and corrosion when hot.

In the case of the first embodiment, the sum of the atomic percentages of chromium and iron may be less than or equal to 35%, for example comprised between 20% and 34%.

In the case of the first embodiment, the difference between the atomic percentage of nickel and the atomic percentage of cobalt (Ni—Co) may be comprised between 5% and 50%, for example between 10% and 48%.

In the case of the first embodiment, the superalloy may comprise, in atomic percentages, 13% to 21% chromium, 4% to 30% cobalt, 4% to 8% aluminum, 4.5% to 8% titanium and 8% to 18% iron.

In the case of the first embodiment, the superalloy may comprise, in atomic percentages, 13% to 17% chromium, 16% to 23% cobalt, 4% to 8% aluminum, 4.5% to 8% titanium and 15% to 18% iron.

In the case of the first embodiment, the superalloy may comprise, in atomic percentages, 16% to 17% chromium, 16% to 17% cobalt, 4.5% to 5.5% aluminum, 4.5% to 5.5% titanium and 16% to 17% iron.

In the case of the first embodiment, the superalloy may comprise, in atomic percentages, 13% to 14% chromium, 21.5% to 22.5% cobalt, 4.5% to 5.5% aluminum, 7% to 8% titanium and 17% to 18% iron.

In the case of the first embodiment, the superalloy may comprise, in atomic percentages, 13% to 21% chromium, 24% to 26% cobalt, 4% to 8% aluminum, 4.5% to 8% titanium and 8% to 11% iron.

In the case of the first embodiment, the superalloy may comprise, in atomic percentages, 19.5% to 20.5% chromium, 24.5% to 25.5% cobalt, 4.5% to 5.5% aluminum, 4.5% to 5.5% titanium and 9.5% to 10.5% iron.

In the case of the first embodiment, the superalloy may comprise, in atomic percentages, 13% to 14% chromium, 24.5% to 25.5% cobalt, 5% to 6% aluminum, 6.5% to 7.5% titanium and 8.5% to 9.5% Iron.

In the case of the second embodiment, the superalloy may comprise between 25% and 36% nickel in atomic percentages.

In the case of the second embodiment, the superalloy may comprise between 8% and 15% iron in atomic percentages.

Such an iron content optimizes the compromise between superalloy mass reduction and resistance to oxidation and corrosion when hot.

In the case of the second embodiment, the sum of the atomic percentages of chromium and iron may be between 18% and 35%, for example between 19% and 24%.

In the case of the second embodiment, the difference between the atomic percentage of cobalt and the atomic percentage of nickel (Co—Ni) may be less than or equal to 10%.

The invention is also directed to a gas turbine engine part comprising a superalloy as described above. The gas turbine engine part may be an aeronautical gas turbine engine part. The gas turbine engine part may be selected from: a gas turbine engine disk, a gas turbine engine casing, a blade, a vane, a portion of a combustor, a portion of an afterburner, a turbine ring sector, a thrust reverser, or an attachment element such as a bolt.

The invention is also directed to a gas turbine engine comprising a gas turbine engine part as described above. The gas turbine engine may be an aeronautical gas turbine engine.

The structure and possible applications for the superalloy in accordance with the invention have just been described. The following section describes the manufacturing details of the superalloy in accordance with the invention.

First, the superalloy of composition described above is obtained by a conventional process such as vacuum arc remelting (VAR) or vacuum induction melting (VIM). A part of the superalloy can also be obtained by forging, extrusion or rolling. The part can also be obtained from a powder formed by spraying an ingot of the superalloy.

Second, the solidification or shaping blank is heat treated.

A heat treatment of the microstructure may be carried out to dissolve the gamma-prime phase precipitates, to eliminate the segregations or, failing that, to reduce them significantly. This treatment is carried out at a temperature higher than the solvus temperature of the gamma-prime phases and lower than the starting melting temperature of the superalloy (Tsolidus). This treatment may be carried out at a temperature greater than or equal to 1100° C., for example comprised between 1100° C. and 1200° C.

Quenching can then be performed after the heat treatment to obtain a fine and homogeneous dispersion of the gamma-prime phase precipitates. The superalloy may be cooled to an end-of-quench temperature less than or equal to 850° C., for example comprised between 20° C. and 850° C., during the quenching treatment.

A tempering heat treatment can then be carried out after quenching at a temperature below the solvus temperature of the gamma-prime phases in order to set the microstructure of the superalloy. The tempering heat treatment may be performed at a temperature comprised between 750° C. and 1000° C. A stable microstructure in which gamma-prime phase precipitates are present in a significant fraction is thus obtained.

The resulting part can then be machined to adjust its dimensions.

BRIEF DESCRIPTION OF THE DRAWINGS

FIG. 1 is a set of photographs showing the microstructure of several examples of superalloys in accordance with the invention.

FIG. 2 is a test result quantifying the volume fractions occupied by hot gamma-prime precipitates for several examples of superalloys in accordance with the invention.

FIG. 3 is a test result quantifying the average radius of hot gamma-prime precipitates for several examples of superalloys in accordance with the invention.

FIG. 4 is a test result quantifying the experimental densities of several examples of superalloys in accordance with the invention.

FIG. 5 is a result of differential scanning calorimetry (DSC) analysis conducted on several examples of superalloys in accordance with the invention.

FIG. 6 is a test result comparing the compressibility of several examples of superalloys in accordance with the invention with that of commercial superalloys outside the invention.

FIG. 7 shows change in the hardness of an example of a superalloy in accordance with the invention during annealing at 900° C.

DESCRIPTION OF THE EMBODIMENTS

The inventors have evaluated the performance of several examples of superalloys in accordance with the invention. The various tests that have been conducted will be detailed below.

The evaluated compositions are detailed in Table 1 below. The contents of the different elements are indicated in atomic percentages.

TABLE 1

| | Ni | Co | Cr | Fe | Al | Ti |
|---|---|---|---|---|---|---|
| TA1 | 40.0 | 16.7 | 16.7 | 16.7 | 5.0 | 5.0 |
| TA2 | 35.0 | 35.0 | 10.0 | 10.0 | 5.0 | 5.0 |
| TA3 | 35.0 | 25.0 | 20.0 | 10.0 | 5.0 | 5.0 |
| TA4 | 52.5 | 4.4 | 13.1 | 17.5 | 7.5 | 5.0 |
| TA5 | 35.0 | 21.9 | 13.1 | 17.5 | 5.0 | 7.5 |

Alloys TA1-TA5 were subjected to a heat treatment in which a first step was imposed at 1150° C. for 48 hours followed by a second step at 900° C. for 403 hours. FIG. 1 shows the microstructure of alloys TA1-TA5 evaluated. The photographs in FIG. 1 show the presence of gamma-prime phase precipitates in each of alloys TA1-TA5.

Alloys TA1-TA5 were heat treated at 900° C. for a duration of 403 hours. The volume fraction of gamma-prime phase precipitates was evaluated using the following method: automated thresholding of 20 images taken by scanning electron microscopy at ×5000 magnification. FIG. 2 quantifies the volume fractions occupied by gamma-prime precipitates for alloys TA1-TA5. It may be seen that the gamma-prime phase precipitates occupy a significant volume fraction thus providing the desired hot hardening.

The average radius of the precipitates was also evaluated by the following method: thresholding of SEM images to obtain about 1500 precipitates per composition, the average radius is defined as the radius of a disk of equivalent area. The results are shown in FIG. 3. It can be seen that relatively small and therefore relatively stable gamma-prime precipitates are obtained. Whatever the embodiment considered, the average radius of the gamma-prime precipitates may be less than or equal to 200 nm. It should be noted that this size of the precipitates remains stable even after exposure to high temperatures. Furthermore, it has been verified by measuring oxidation kinetic constants that the superalloys in accordance with the invention are classified as chromium formers by being protected by the formation of protective layers of chromium oxide $Cr_2O_3$.

The experimental densities of alloys TA1-TA5 were quantified and the results obtained are provided in FIG. 4. It may be seen that the superalloys in accordance with the invention have limited densities, all of which are less than 8.1 g/cm$^3$.

The solution window of alloys TA1-TA5 was evaluated by differential scanning calorimetry analysis (see FIG. 5). It may be seen that the solvus temperature of each of the alloys is relatively high and close to 1100° C., indicating the effective contribution of these precipitates to the hot hardness increase over a wide temperature range.

The compressibility of the alloys was evaluated at 900° C. on a Gleeble machine and compared with that of the commercial Inconel 718 alloy outside the invention (see FIG. 6). The superalloys in accordance with the invention have good mechanical properties, superior to those of Inconel 718 alloy, while having a significantly lower density.

FIG. 7, in turn, shows the change in hardness, measured at 25° C., of alloy TA5 during annealing at 900° C. The hardness of the alloy remains above 430 Hv even after several hours at high temperature.

Other examples of alloy compositions than those shown in Table 1 above have been identified as preferential by the inventors, namely (compositions given in atomic percentages):

TA6: 40.4% Ni-25.2% Co-13.1% Cr-8.8% Fe-5.5% Al-7% Ti, and

TA7: 28% Ni-37.6% Co-13.1% Cr-8.8% Fe-4.5% Al-8% Ti.

The expression "comprised between . . . and . . . " should be understood as including the bounds.

The invention claimed is:

1. A gas turbine engine part comprising a nickel-based superalloy comprising chromium, cobalt, aluminum, titanium, iron, boron in an atomic percentage less than or equal to 0.5% or no boron, carbon in an atomic percentage less than or equal to 1% or no carbon, at least one additional element selected from molybdenum, tungsten, tantalum and niobium, a total atomic content of the at least one additional element being less than or equal to 1.5% or no such at least one additional element, the remainder being nickel and unavoidable impurities, with a sum of the atomic percentages of aluminum and titanium being comprised between 9% and 13.5%, and the superalloy satisfying one of the following conditions:

the superalloy comprising, in atomic percentages, 16% to 17% chromium, 16% to 17% cobalt, 4.5% to 5.5% aluminum, 4.5% to 5.5% titanium and 16% to 17% iron, or the superalloy comprising, in atomic percentages, 13% to 14% chromium, 21.5% to 22.5% cobalt, 4.5% to 5.5% aluminum, 7% to 8% titanium and 17% to 18% iron, or the superalloy comprising, in atomic percentages, 19.5% to 20.5% chromium, 24.5% to 25.5% cobalt, 4.5% to 5.5% aluminum, 4.5% to 5.5% titanium and 9.5% to 10.5% iron, or the superalloy comprising, in atomic percentages, 13% to 14% chromium, 24.5% to 25.5% cobalt, 5% to 6% aluminum, 6.5% to 7.5% titanium and 8.5% to 9.5% iron.

2. A turbomachine comprising a gas turbine engine part as claimed in claim 1.

* * * * *